US008377618B2

(12) United States Patent
Shu et al.

(10) Patent No.: US 8,377,618 B2
(45) Date of Patent: Feb. 19, 2013

(54) IMAGE FORMING METHOD, IMAGE FORMING APPARATUS, AND TONER

(75) Inventors: Hyo Shu, Mishima (JP); Yasuaki Iwamoto, Numazu (JP); Yasutada Shitara, Numazu (JP); Minoru Masuda, Numazu (JP)

(73) Assignee: Ricoh Company Limited, Tokyo (JP)

( * ) Notice: Subject to any disclaimer, the term of this patent is extended or adjusted under 35 U.S.C. 154(b) by 1117 days.

(21) Appl. No.: 12/210,536

(22) Filed: Sep. 15, 2008

(65) Prior Publication Data

US 2009/0075195 A1 Mar. 19, 2009

(30) Foreign Application Priority Data

Sep. 14, 2007 (JP) ..... 2007-238829
Jul. 25, 2008 (JP) ..... 2008-192566

(51) Int. Cl.
*G03G 15/01* (2006.01)

(52) U.S. Cl. ..... 430/109.4; 430/109.1; 430/109.2; 430/109.3

(58) Field of Classification Search ..... 430/108.1, 430/10.4, 109.1, 109.2, 109.3, 109.4
See application file for complete search history.

(56) References Cited

U.S. PATENT DOCUMENTS

| | | | | |
|---|---|---|---|---|
| 7,163,774 | B2 | 1/2007 | Shiraishi et al. | |
| 7,169,525 | B2 | 1/2007 | Sugiura et al. | |
| 2007/0148579 | A1 * | 6/2007 | Mera et al. | 430/109.4 |
| 2007/0184377 | A1 | 8/2007 | Shu et al. | |
| 2007/0218384 | A1 * | 9/2007 | Matsumoto et al. | 430/108.1 |

FOREIGN PATENT DOCUMENTS

| | | |
|---|---|---|
| JP | 41-20153 | 11/1966 |
| JP | 42-1627 | 1/1967 |
| JP | 43-27596 | 11/1968 |
| JP | 44-6397 | 3/1969 |
| JP | 45-26478 | 9/1970 |
| JP | 55-42752 | 11/1980 |
| JP | 5-7385 | 2/1984 |
| JP | 60-90344 | 5/1985 |
| JP | 62-63940 | 3/1987 |
| JP | 64-15755 | 1/1989 |
| JP | 2-82267 | 3/1990 |
| JP | 3-41470 | 2/1991 |
| JP | 3-229264 | 10/1991 |
| JP | 2931899 | 5/1999 |
| JP | 11-305486 | 11/1999 |
| JP | 3310253 | 5/2002 |
| JP | 2002-214833 | 7/2002 |
| JP | 2005-338814 | 12/2005 |

OTHER PUBLICATIONS

U.S. Appl. No. 11/956,378, filed Dec. 14, 2007, Shu, et al.
U.S. Appl. No. 11/950,114, filed Dec. 4, 2007, Shitara, et al.

* cited by examiner

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner is provided including a mother toner including a crystalline polyester resin, an amorphous resin, and a wax, and an external additive in an amount of from 0.30 to 0.55 parts by weight based on 100 parts by weight of the mother toner. The toner satisfies the following equation $0.36 \leqq (2.77 \times C/R + 1.97 \times W/R)/X \leqq 1.85$, wherein each of C, W, and R represents a height of an absorbance peak specific to the crystalline polyester resin, the wax, and the amorphous resin, respectively, measured by a FT-IR ATR method, and X represents an amount (parts by weight) of the external additive. An image forming method and apparatus using the toner are also provided.

9 Claims, 4 Drawing Sheets

IMAGE FORMING METHOD, IMAGE FORMING APPARATUS, AND TONER

BACKGROUND OF THE INVENTION

1. Field of the Invention

The present invention relates to an image forming method and apparatus capable of forming images at ultra-high speeds, and a toner applicable to the image forming method and apparatus.

2. Discussion of the Background

Demands for high-speed printing and high quality images are increasing in the electrophotographic industry recently. Generally speaking, however, the higher the image forming speed (hereinafter "system speed") of an image forming apparatus, the worse the resultant image quality. Specifically, fixability of a toner deteriorates as the system speed increases, thereby degrading the resultant image quality. For this reason, a technique for providing both high-speed printing and good fixing performance is needed.

A toner image is typically fixed on a recording medium, such as paper, by application of heat and pressure in a fixing device. As the system speed increases, the toner image receives less heat in the fixing device. As a result, the toner may not be fixed on the recording medium and may release therefrom.

To prevent the deterioration of the image quality even when the system speed increases, one proposed approach involves increasing a fixing temperature. However, this approach has a possibility of causing side effects of temperature rise inside an image forming apparatus, short life of a fixing member, and consumption of a large amount of energy. Therefore, a toner itself is required to have improved fixability especially for use in ultrahigh-speed machines. Specifically, a toner is needed that is capable of providing good fixability with less heat even when used in a high-speed fixing device.

Various attempts have been made to improve fixability of a toner. For example, one proposed approach involves controlling thermal properties of a binder resin. However, if the glass transition temperature (Tg) of a binder resin is reduced, thermostable preservability and fixing strength of the resultant toner may deteriorate. Alternatively, if the molecular weight of a binder resin is reduced, a hot offset problem may occur and the resultant image may be too glossy. The "hot offset" here refers to an undesirable phenomenon in which part of a fused toner image is adhered to the surface of a heat member, and re-transferred onto an undesired portion of a recording medium. Consequently, a toner having a good combination of fixability and thermostable preservability is not yet provided only by controlling thermal properties of binder resins.

Accordingly, toners using polyester resins, which are fixable at lower temperatures and have better thermostable preservability than conventionally-used styrene-acrylic resins, are disclosed in Unexamined Japanese Patent Applications Publications Nos. (hereinafter "JP-A") 60-90344, 64-15755, 02-82267, 03-229264, 03-41470, and 11-305486. In addition, JP-A 62-63940 discloses a toner including a binder resin including a non-polyolefin crystalline polymer so as to improve fixing ability at low temperatures (hereinafter "low-temperature fixability"). However, the molecular structure and molecular weight of the non-polyolefin crystalline polymer is not optimized therein.

Japanese Patent No. (hereinafter "JP") 2931899 and JP-A 2001-222138 each disclose a toner including a crystalline polyester having a quickly-melting property, as well as the above-described non-polyolefin crystalline polymer, with an intention of improving fixability of the toner. However, the toner of JP 2931899 has poor affinity for paper because of having too low an acid value of 5 or less and too low a hydroxyl value of 20 or less, resulting in poor low-temperature fixability. Further, the molecular structure and molecular weight of the crystalline polymer in not optimized in JP-A 2001-222138. Such a toner may not provide low-temperature fixability either when an oil is applied to a fixing roller or not. Consequently, such a toner may not provide a good combination of low-temperature fixability, hot offset resistance, thermostable preservability, transferability, durability, charge stability in humid conditions, and pulverization efficiency.

Further, JP-A 2002-214833 discloses a toner including a crystalline polyester and an amorphous crystalline polyester having no affinity with each other, forming a sea-island phase-separated structure. A DSC curve of THF-soluble components of the toner has a maximum peak at a specific temperature, so that the toner has both low-temperature fixability and thermostable preservability. However, such a toner does not solve the problems of inconsistent image density and image defects caused by an undesired toner film formed on an image bearing member.

JP-A 2005-338814 also discloses a toner including a crystalline polyester resin. However, this toner may form an undesirable toner film on image forming components, resulting in unreliable image quality.

As described above, a crystalline polyester resin improves low-temperature fixability of a toner. However, a toner including a crystalline polyester resin has a drawback that the toner tends to form undesirable films thereof on the surface of an image bearing member (hereinafter "filming problem"), thereby causing image defects, specifically, white spots in the resultant image.

It is considered that the filming problem is caused due to the nature of a crystalline polyester resin. More specifically, it is considered that the crystalline polyester resin exudes to the surface of the toner, and then contaminates an image bearing member, resulting in occurrence of the filming problem.

A wax and other external additives also have an influence on low-temperature fixability and the occurrence of the filming problem.

The presence of a wax improves low-temperature fixability of a toner. Further, a wax is considered to promote a crystalline polyester resin to exude from the toner. Therefore, as the amount of a wax included in a toner increases, the filming problem may more easily occur.

On the other hand, an external additive has a function of scraping off undesirable toner films formed on an image bearing member. Therefore, as the amount of an external additive added to a toner increases, the filming problem may occur much less. However, as the amount of an external additive added to a toner increases, the void ratio of an unfixed toner image increases, thereby degrading thermal conductivity of the unfixed toner image when fixed on a recording medium. Further, too large an amount of an external additive may disturb fixation of an unfixed toner image.

SUMMARY OF THE INVENTION

Accordingly, an object of the present invention is to provide an image forming method and apparatus capable of providing high-speed and low-temperature fixing while producing high quality images without white spots.

Another object of the present invention is to provide a toner usable in the above-described image forming method and apparatus, which is fixable at low temperatures while not forming an undesirable film thereof on an image bearing member.

These and other objects of the present invention, either individually or in combinations thereof, as hereinafter will become more readily apparent, can be attained by an image forming method, comprising:

charging a surface of an image bearing member;

irradiating the charged surface of the image bearing member to form an electrostatic latent image thereon;

developing the electrostatic latent image with a developer comprising a toner to form a toner image;

transferring the toner image onto a recording medium directly or via a transfer member to form an unfixed toner image;

cleaning residual toner particles remaining on the image bearing member; and fixing the unfixed toner image on the recording medium, wherein a system speed is from 500 to 1700 mm/sec, and wherein the toner comprises:

a mother toner comprising a crystalline polyester resin, an amorphous resin, and a wax; and an external additive in an amount of from 0.30 to 0.55 parts by weight based on 100 parts by weight of the mother toner, wherein the toner satisfies the following equation (1):

$$0.36 \leqq (2.77 \times C/R + 1.97 \times W/R)/X \leqq 1.85 \quad (1)$$

wherein each of C, W, and R represents a height of an absorbance peak specific to the crystalline polyester resin, the wax, and the amorphous resin, respectively, measured by a FT-IR ATR method; and X represents an amount (parts by weight) of the external additive;

an image forming apparatus, comprising:

an image bearing member configured to bear an electrostatic latent image;

a charging device configured to charge a surface of the image bearing member;

an irradiating device configured to write an electrostatic latent image on the surface of the image bearing member;

a developing device configured to develop the electrostatic latent image with a developer comprising the above-described toner to form a toner image;

a transfer device configured to transfer the toner image onto a recording medium directly or via a transfer member to form an unfixed toner image;

a cleaning device configured to remove residual toner particles remaining on the image bearing member; and a fixing device configured to fix the unfixed toner image on the recording medium, wherein the image forming apparatus has a system speed of from 500 to 1700 mm/sec; and the above-described toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

The present invention will be described in detail below referring to drawings.

Figure 1:
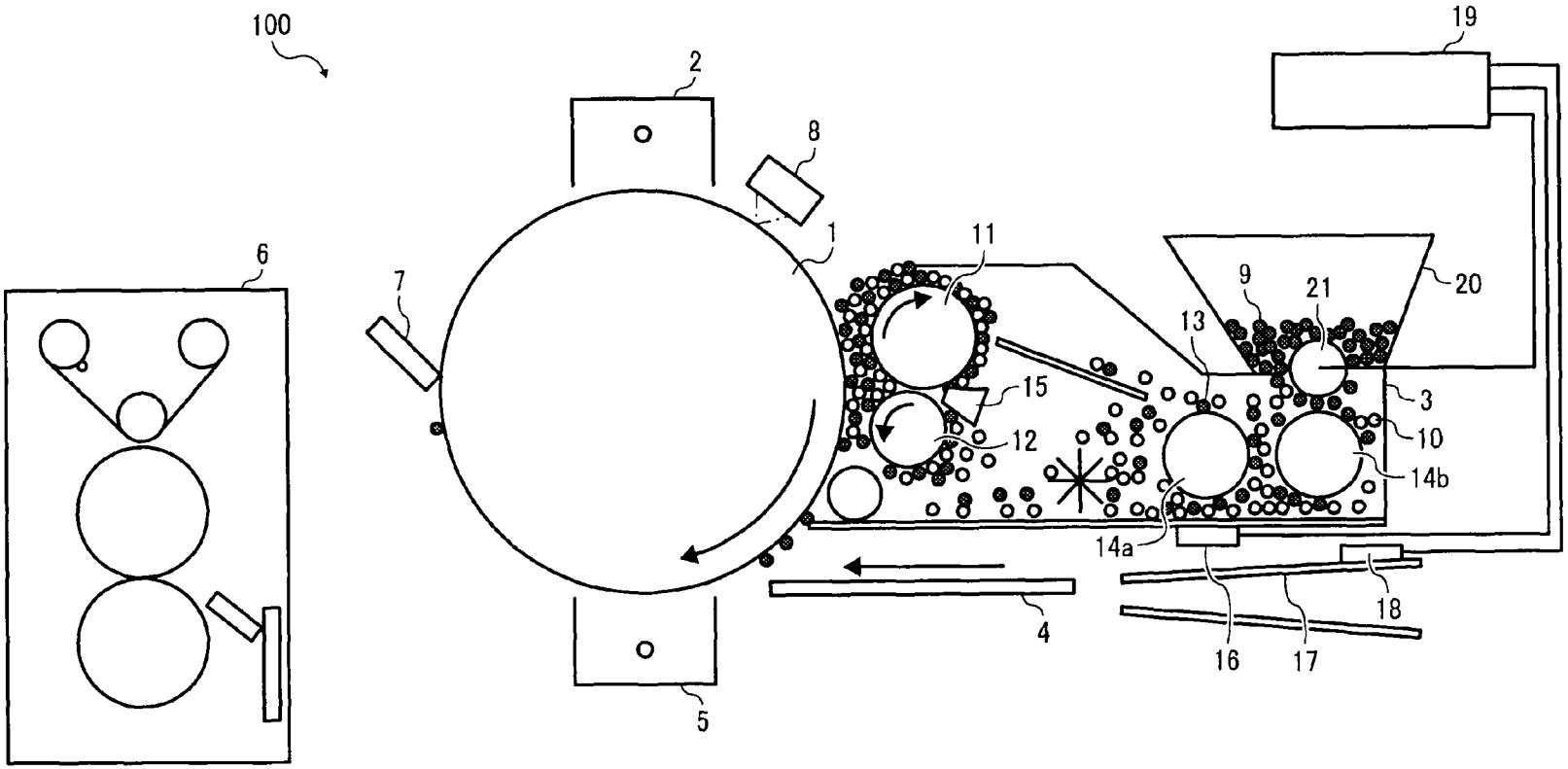
FIG. 1 is a schematic view illustrating an example embodiment of an image forming apparatus of the present invention.

FIG. 1 is a schematic view illustrating an example embodiment of an image forming apparatus of the present invention.

An image forming apparatus 100 illustrated in FIG. 1 includes an image bearing member 1 configured to bear an electrostatic latent image, a charging device 2 configured to charge a surface of the image bearing member 1, an irradiating device 8 configured to write an electrostatic latent image on the surface of the image bearing member 1, a developing device 3 configured to develop the electrostatic latent image with a developer 13 containing a toner 9 to form a toner image, a transfer device 5 configured to transfer an unfixed toner image onto a recording medium 4 directly or via a transfer member, a cleaning device 7 configured to remove residual toner particles remaining on the surface of the image bearing member 1, and a fixing device 6 configured to fix the unfixed toner image on the recording medium. The image forming apparatus 100 has a system speed of from 500 to 1700 mm/sec. The toner 9 includes a mother toner and an external additive in an amount of from 0.30 to 0.55 parts by weight based on 100 parts by weight of the mother toner. The mother toner includes a crystalline polyester resin, an amorphous resin, and a wax. The toner 9 satisfies the following equation (1):

$$0.36 \leqq (2.77 \times C/R + 1.97 \times W/R)/X \leqq 1.85 \quad (1)$$

wherein each of C, W, and R represents a height of an absorbance peak specific to the crystalline polyester resin, the wax, and the amorphous resin, respectively, measured by a FT-IR ATR method, and X represents an amount (parts by weight) of the external additive.

The charging device 2 evenly charges the surface of the image bearing member 1, and subsequently the irradiating device 8 writes an electrostatic latent image thereon. The developing device 3 develops the electrostatic latent image with the developer 13 containing the toner 9. Thus, a toner image is formed on the image bearing member 1.

Any known organic photoreceptor and inorganic photoreceptor used for typical image forming apparatuses can be used as the image bearing member 1 in the present invention.

Any known charging device and irradiating device used for typical image forming apparatuses can be used as the charging device 2 and the irradiating device 8, respectively, in the present invention.

The developing device 3 includes a forward developing roller 11 and a reverse developing roller 12 each rotating in the forward (i.e., counterclockwise) and reverse (i.e., clockwise) directions, respectively, relative to a direction of rotation of the image bearing member 1. The developing device 3 has a center feed configuration in which the forward developing roller 11 and the reverse developing roller 12 are provided upstream and downstream, respectively, relative to a direction of rotation of the image bearing member 1, so as to face with each other. A toner supply member 21 supplies the toner 9 from a container 20 onto an auger-shaped agitation member 14*b*, so that the toner 9 is mixed and agitated with a carrier 10 or the developer 13 while being conveyed to a front side of the plane of paper. Subsequently, the toner 9 is further mixed and agitated with the carrier 10 or the developer 13 by an auger-shaped agitation member 14*a* while being conveyed to a back side of the plane of paper. In the process of conveying the developer 13 by the auger-shaped agitation member 14*a*, the developer 13 is supplied to the developing rollers 11 and 12 so as to contribute to development of the electrostatic latent image. A control member 15 then properly controls the amount of the developer 13 borne by the developing rollers 11 and 12. Although a single forward developing roller 11 and a single reverse developing roller 12 are provided in FIG. 1, alternatively, a plurality of each developing roller may be provided, if desired.

A toner concentration detector 16 is provided immediately below the auger-shaped agitation member 14*a* forming a proper gap therebetween. A temperature sensor 18 configured to detect the temperature of the developing device 3 is provided adjacent to the developing device 3 inside the image forming apparatus 100. A control unit 19 is provided inside the image forming apparatus 100. The control unit 19 is configured to compare a toner concentration detected by the toner concentration detector 16 and a set toner concentration, and to drive the toner supply member 21 when the toner concentration is in short supply.

The toner image on the image bearing member 1 is transferred onto the recording medium 4, such as paper, by the transfer device 5. The transfer device 5 may transfer the toner image onto the recording medium 4 conveyed by a paper feed guide plate 17 either directly or via a transfer member such as an intermediate transfer belt. Residual toner particles which are not transferred but which remain on the image bearing member 1 are then removed by the cleaning device 7 including a cleaning blade. On the other hand, the toner image transferred onto the recording medium 4 is then fixed thereon in the fixing device 6. The image thus formed is discharged out of the image forming apparatus 100. The image forming method of the present invention preferably includes the above-described series of image forming processes.

Any known cleaning device such as a cleaning blade and a cleaning brush used for typical image forming apparatuses can be used as the cleaning device 7 in the present invention.

When $(2.77\times C/R+1.97\times W/R)/X$ is less than 0.36, low-temperature fixability of the toner 9 may be unreliable. When $(2.77\times C/R+1.97\times W/R)/X$ is greater than 1.85, the toner 9 tends to form undesirable films thereof on the image bearing member 1, possibly causing white spots in the resultant image.

Preferably, the toner 9 further satisfies the following equation (2):

$$0.36\leqq(2.77\times C/R+1.97\times W/R)/X\leqq 0.75 \quad (2)$$

Preferably, the toner 9 further satisfies the following equation (3):

$$0.03\leqq C/R\leqq 0.15 \quad (3)$$

C/R indicates the ease of the crystalline polyester resin exuding out to the surface of the toner 9. When C/R is greater than 0.15, the toner 9 may have improved low-temperature fixability, while too much exudation of the crystalline polyester resin causes strong adhesion of the toner 9 to the image bearing member 1. When C/R is less than 0.03, the crystalline polyester resin may hardly exude to the surface of the toner 9, thereby preventing the strong adhesion of the toner 9 to the image bearing member 1. However, the toner 9 may have poor low-temperature fixability.

C/R is measured by a FT-IR ATR (Fourier transform infrared total reflectance) method, which will be described in detail later.

W/R indicates the ease of the wax exuding out to the surface of the toner 9. When W/R is large, the toner 9 may have improved low-temperature fixability, while too much exudation of the wax causes strong adhesion of the toner 9 to the image bearing member 1. When W/R is small, the wax may hardly exude to the surface of the toner 9, thereby preventing the strong adhesion of the toner 9 to the image bearing member 1. However, the toner 9 may have poor low-temperature fixability.

W/R is measured by a FT-IR ATR (Fourier transform infrared total reflectance) method, which will be described in detail later.

C/R and W/R are greatly influenced by a compatible state of the crystalline polyester resin with the amorphous resin, degree of recrystallization, and so forth. To manufacture a toner satisfying the equation (1), manufacturing conditions need to be optimized. For example, manufacturing conditions in kneading, pulverization, mixing, and the like processes can be optimized using a method according to quality engineering. For example, the longer the time between kneading and pulverization processes, the greater the C/R. The less the kneading temperature and extruding speed and the narrower the cooling gap, the less the C/R and W/R.

By controlling C/R and W/R to have specific values, high-speed and low-temperature fixing can be provided while producing high quality images without white spots.

Each of C/R and W/R represents a height ratio of a peak specific to the crystalline polyester resin and the wax, respectively, to that specific to the amorphous resin, in an absorbance spectrum measured by an ATR (total reflection) method using a FT-IR (Fourier transform infrared) apparatus such as AVATAR 370 from Thermo Electron Corporation. Since the ATR method requires a measuring target to have a smooth surface, the toner needs to be pelletized before the measurement. Specifically, 2.0 g of toner is formed into a pellet having a diameter of 20 mm by being compressed with a load of 1 t for 60 seconds.

Figure 2:
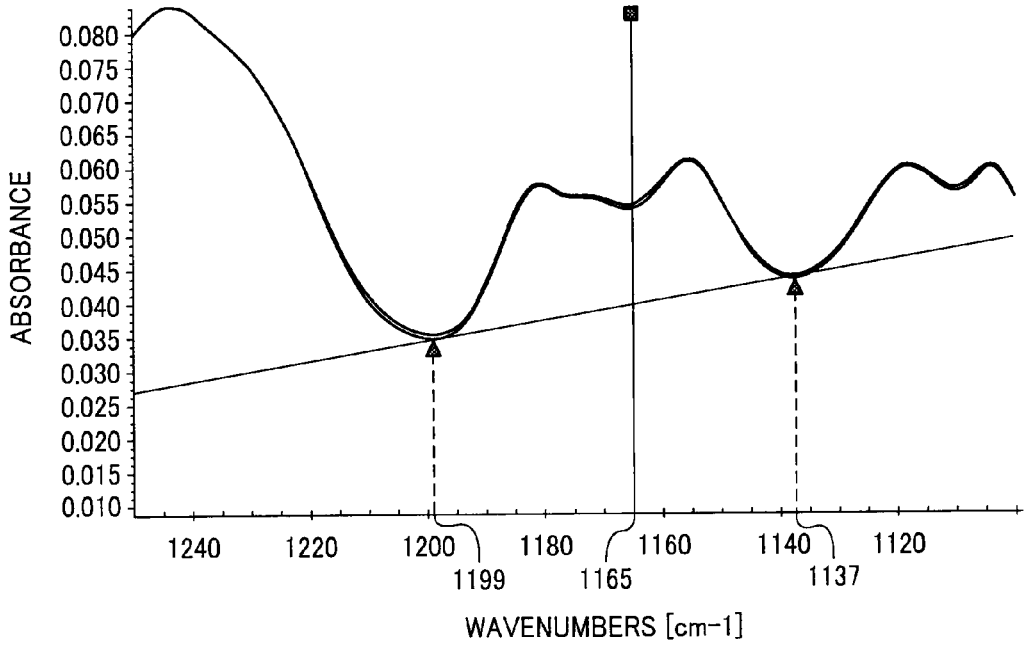
FIG. 2 is a graph showing an absorbance spectrum of a crystalline polyester resin measured by a FT-IR ATR method.
Figure 3:
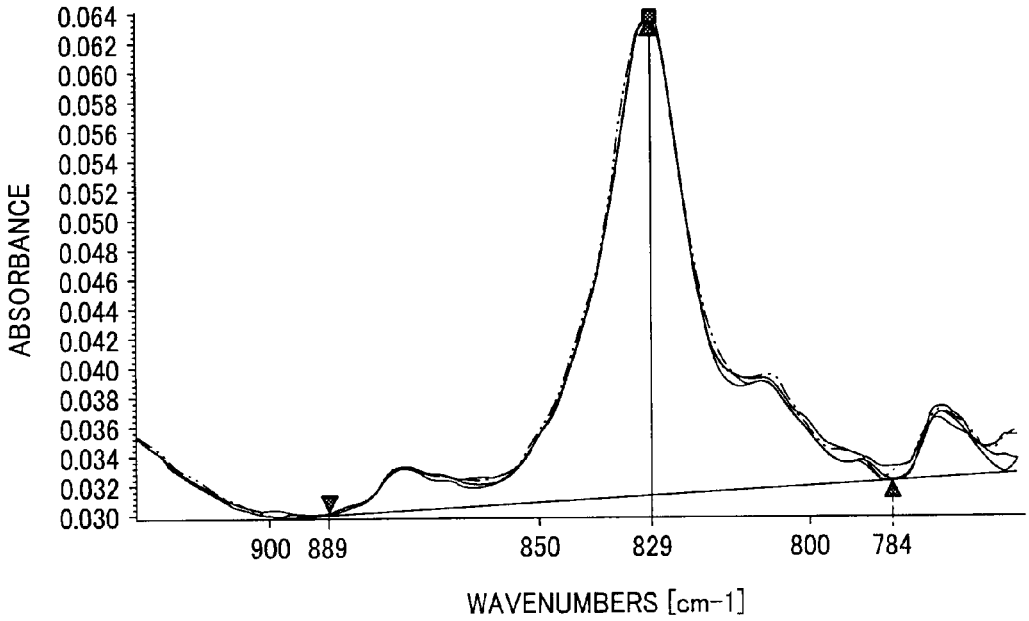
FIG. 3 is a graph showing an absorbance spectrum of an amorphous polyester resin measured by a FT-IR ATR method.
Figure 4:
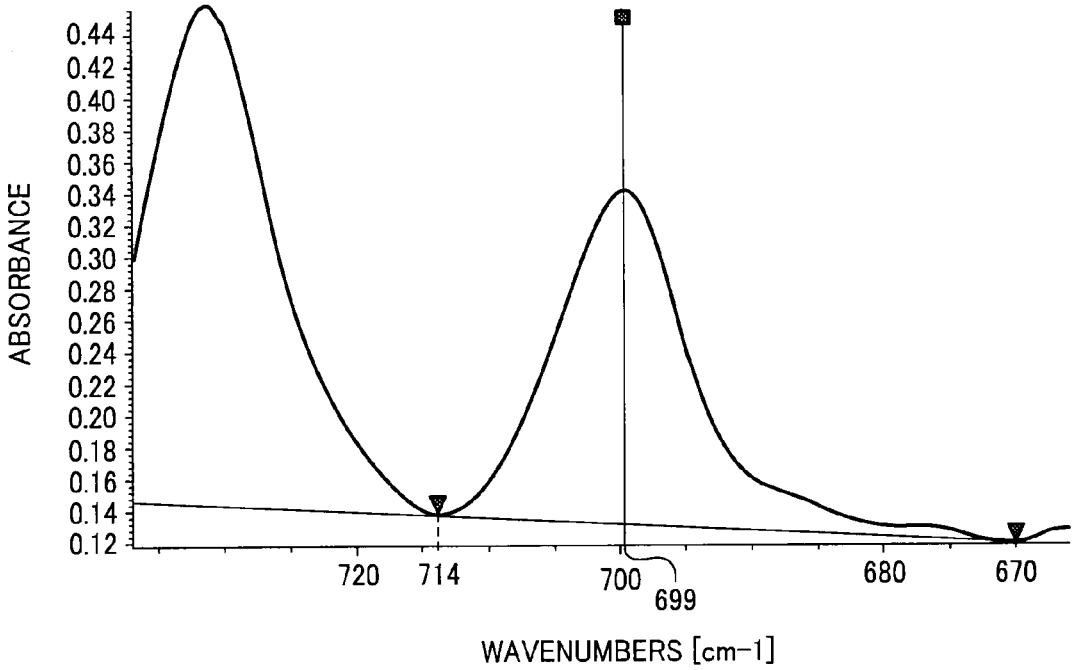
FIG. 4 is a graph showing an absorbance spectrum of an amorphous styrene-acrylic resin measured by a FT-IR ATR method.

C represents a height of an absorbance peak specific to the crystalline polyester in a crystalline state observed at a wavenumber of 1165 $cm^{-1}$, a baseline of which is drawn from 1137 to 1199 $cm^{-1}$, as shown in FIG. 2. W represents a height of an absorbance peak originated from C—H stretching of alkyl chains in the wax observed at a wavenumber of 2850 $cm^{-1}$, a baseline of which is drawn from 2834 to 2862 $cm^{-1}$. R represents a height of an absorbance peak specific to the amorphous resin. When the amorphous resin is a polyester resin, the absorbance peak is observed at a wavenumber of 829 $cm^{-1}$, a baseline of which is drawn from 784 to 889 $cm^{-1}$, as shown in FIG. 3. When the amorphous resin is a styrene-acrylic resin, the absorbance peak is observed at a wavenumber of 699 $cm^{-1}$, a baseline of which is drawn from 670 to 714 $cm^{-1}$, as shown in FIG. 4. C/R and W/R are calculated from the measured values of C, W, and R.

In the formulae (1) and (2), X represents the amount (parts by weight) of the external additive added to 100 parts by weight of the mother toner. X is preferably from 0.30 to 0.55 parts by weight. When X is too small, a function of the external additive of scraping off undesirable toner films formed on the image bearing 1 is weakened. When X is too large, void ratio of an unfixed toner image increases, thereby degrading thermal conductivity of the unfixed toner image when fixed on a recording medium. Further, an excessive amount of the external additive may form undesirable films thereof (such as silica films) on the image bearing member 1. X is measured by a fluorescent X-ray method.

Preferably, the system speed is from 500 to 1700 mm/sec in the present invention. The system speed here refers to an image forming speed which is identical to a conveyance speed of the recording medium 4. Therefore, when 100 sheets of A4-size paper (having a vertical length of 297 mm) are continuously outputted in a vertical direction, the system speed can be calculated from the following equation:

$$B\ (\text{mm/sec})=100\ (\text{sheets})\times 297\ (\text{mm})/A\ (\text{sec})$$

wherein A represents an outputting time (sec) and B represents a system speed (mm/sec).

As described above, the toner 9 comprises a mother toner and an external additive. The mother toner comprises a crystalline polyester resin, an amorphous polyester resin, and a wax.

Specific examples of usable amorphous resins include polyester resins, but not limited thereto. Specifically, polyester resins include a polyester resin (AX) which is a polycondensation product of a polyol with a polycarboxylic acid, and a modified polyester resin (AY) which is a reaction product of the polyester resin (AX) with a polyepoxide (c). Each of the polyester resins (AX) and (AY) can be used alone or in combination.

As the polyol, diols (g) and polyols (h) having 3 or more valences can be used. Each of the diols (g) and the polyols (h) can be used alone or in combination. As the polycarboxylic acid, dicarboxylic acids (i) and polycarboxylic acids (j) having 3 or more valences can be used. Each of the dicarboxylic acids (i) and the polycarboxylic acids (j) can be used alone or in combination.

Specifically, the polyester resins (AX) include a linear polyester resin (AX1) derived from the diol (g) and the dicarboxylic acid (i), and a non-linear polyester (AX2) derived from the diol (g) and the dicarboxylic acid (i) together with the polyol (h) and/or the polycarboxylic acid (j). The modified polyester resins (AY) include a modified polyester resin (AY1) which is a reaction product of the non-linear polyester (AX2) with the polyepoxide (c). These resins can be used alone or in combination.

The diol (g) preferably has a hydroxyl value of from 180 to 1900 mgKOH/g. Specific examples of usable diols (g) include, but are not limited to, alkylene glycols having 2 to 36 carbon atoms (e.g., ethylene glycol, 1,2-propylene glycol, 1,3-propylene glycol, 1,4-butyleneglycol, 1,6-hexanediol), alkylene ether glycols having 4 to 36 carbon atoms (e.g., diethylene glycol, triethylene glycol, dipropylene glycol, polyethylene glycol, polypropylene glycol, polybutylene glycol), alicyclic diols having 6 to 36 carbon atoms (e.g., 1,4-cyclohexanedimethanol, hydrogenated bisphenol A), alkylene oxide having 2 to 4 carbon atoms (i.e., ethylene oxide (EO), propylene oxide (PO), butylene oxide (BO)) 1 to 30 mol adducts of the alicyclic diols, and alkylene oxide having 2 to 4 carbon atoms (i.e., EO, PO, BO) 2 to 30 mol adducts of bisphenols (e.g., bisphenol A, bisphenol F, bisphenol S).

Among these compounds, alkylene glycols having 2 to 12 carbon atoms, alkylene oxide adducts of bisphenols, and mixtures thereof are preferably used, and alkylene oxide adducts of bisphenols, alkylene glycols having 2 to 4 carbon atoms, and mixtures thereof are more preferably used.

The hydroxyl value and acid value are measured by a method according to JIS K 0070.

The polyol (h) having 3 or more valences preferably has a hydroxyl value of from 150 to 1900 mgKOH/g. Specific examples of usable polyols (h) having 3 or more valences include, but are not limited to, aliphatic polyvalent alcohols having 3 to 36 carbon atoms (e.g., alkanepolyols and intramolecular or intermolecular dehydration products thereof such as glycerin, triethylolethane, trimethylolpropane, pentaerythritol, sorbitol, sorbitan, polyglycerin, and dipentaerythritol; saccharides and derivatives thereof such as sucrose and methyl glucoside), alkylene oxide having 2 to 4 carbon atoms (i.e., EO, PO, BO) 1 to 30 mol adducts of the aliphatic polyvalent alcohols, alkylene oxide having 2 to 4 carbon atoms (i.e., EO, PO, BO) 2 to 30 mol adducts of trisphenols (e.g., trisphenol PA), and alkylene oxide having 2 to 4 carbon atoms (i.e., EO, PO, BO) 2 to 30 mol adducts of novolac resins (e.g., phenol novolac, cresol novolac) having an average polymerization degree of from 3 to 60.

Among these compounds, aliphatic polyvalent alcohols having 3 or more valences and alkylene oxide 2 to 30 mol adducts of novolac resins are preferably used, and alkylene oxide 2 to 30 mol adducts of novolac resins are more preferably used.

The dicarboxylic acid (i) preferably has an acid value of from 180 to 1250 mgKOH/g. Specific examples of usable dicarboxylic acids (i) include, but are not limited to, alkanedicarboxylic acids having 4 to 36 carbon atoms (e.g., succinic acid, adipic acid, sebacic acid) and alkenylsuccinic acids (e.g., dodecenylsuccinic acid), alicyclic dicarboxylic acids having 4 to 36 carbon atoms (e.g., dimer acids such as dimerized linoleic acid), alkenedicarboxylic acids having 4 to 36 carbon atoms (e.g., maleic acid, fumaric acid, citraconic acid, mesaconic acid), and aromatic dicarboxylic acids having 8 to 36 carbon atoms (e.g., phthalic acid, isophthalic acid, terephthalic acid, naphthalenedicarboxylic acid). Among these compounds, alkenedicarboxylic acids having 4 to 20 carbon atoms and aromatic dicarboxylic acids having 8 to 20 carbon atoms are preferably used. In addition, acid anhydrides and lower alkyl (having 1 to 4 carbon atoms) esters (e.g., methyl ester, ethyl ester, isopropyl ester) of the above-described compounds can also be used as the dicarboxylic acid (i).

The polycarboxylic acid (j) having 3 or more valences preferably has an acid value of from 150 to 1250 mgKOH/g. Specific examples of usable polycarboxylic acids (j) include, but are not limited to, aromatic polycarboxylic acids having 9 to 20 carbon atoms (e.g., trimellitic acid, pyromellitic acid), and vinyl polymers of unsaturated carboxylic acids having a number average molecular weight (Mn) of from 450 to 10000 measured by gel permeation chromatography (GPC) (e.g., styrene-maleic acid copolymer, styrene-acrylic acid copolymer, α-olefin-maleic acid copolymer, styrene-fumaric acid copolymer). Among these compounds, aromatic polycarboxylic acids having 9 to 20 carbon atoms are preferably used. Specifically, trimellitic acid and pyromellitic acid are more preferably used. In addition, acid anhydrides and lower alkyl (having 1 to 4 carbon atoms) esters (e.g., methyl ester, ethyl ester, isopropyl ester) of the above-described compounds can also be used as the polycarboxylic acid (j) having 3 or more valences.

Further, aliphatic or aromatic hydroxycarboxylic acids (k) having 4 to 20 carbon atoms and/or lactones (l) having 6 to 12 carbon atoms can be copolymerized with the diol (g), polyol (h), dicarboxylic acid (i) and/or polycarboxylic acid (j).

Specific examples of usable hydroxycarboxylic acids (k) include, but are not limited to, hydroxystearic acid and hydrogenated castor oil. Specific examples of usable lactones (l) include, but are not limited to, caprolactone.

Specific examples of usable polyepoxides (c) include, but are not limited to, polyglycidyl ethers (e.g., ethylene glycol glycidyl ether, tetramethylene glycol glycidyl ether, bisphenol A diglycidyl ether, bisphenol F diglycidyl ether, glycerin triglycidyl ether, pentaerythritol tetraglycidyl ether, glycidyl ether compounds of phenol novolacs having an average polymerization degree of from 3 to 60), and diene oxides (e.g., pentadiene dioxide, hexadiene dioxide). Among these compounds, polyglycidyl ethers are preferably used, and ethylene glycol diglycidyl ether and bisphenol A diglycidyl ether are more preferably used.

The polyepoxide (c) preferably includes epoxy groups in a number of from 2 to 8, more preferably 2 to 6, and much more preferably from 2 to 4, per molecule.

The polyepoxide (c) preferably has an epoxy equivalent of from 50 to 500, more preferably from 70 to 300, and much more preferably from 80 to 200.

When the number of epoxy groups and epoxy equivalent are in the above-described ranges, both developability and fixability of the resultant toner may improve.

When a polyol and a polycarboxylic acid are reacted, an equivalent ratio ([OH]/[COOH]) of hydroxyl group [OH] to carboxyl group [COOH] is preferably from 2/1 to 1/2, more preferably from 1.5/1 to 1/1.3, and much more preferably from 1.3/1 to 1/1.2. The kinds of polyol and polycarboxylic acid are selected in consideration of the molecular weight so that the resultant amorphous polyester resin has a glass transition temperature of from 45 to 85° C.

The amorphous polyester resin for use in the present invention is obtainable by a typical manufacturing method of a polyester resin. For example, the polycondensation reaction may be performed in an atmosphere of an inert gas (such as nitrogen gas) in the presence of titanium carboxylate (hereinafter "titanium-containing catalyst (a)") at a reaction temperature of from 150 to 280° C., preferably from 160 to 250° C., and more preferably from 170 to 240° C. To consistently perform the polycondensation reaction, the reaction time is preferably 30 minutes or more, and more preferably from 2 to 40 hours. It is advantageous to reduce pressure (to from 1 to 50 mmHg, for example) so that the reaction speed increases in a terminal stage of the reaction.

From the viewpoint of polymerization activity, the amount of the titanium-containing catalyst (a) is preferably from 0.0001 to 0.8% by weight, more preferably from 0.0002 to 0.6% by weight, and much more preferably from 0.0015 to 0.55% by weight, based on the resultant polymer.

Further, other esterification catalysts can be used in combination so long as catalytic effect of the titanium-containing catalyst (a) does not deteriorate. Specific examples of usable esterification catalysts include, but are not limited to, tin-containing catalysts (e.g., dibutyltin oxide), antimony trioxide, titanium-containing catalysts other than the titanium-containing catalyst (a) (e.g., halogenated titanium, titanium diketone enolate, titanyl carboxylate), zirconium-containing catalysts (e.g., zirconyl acetate), germanium-containing catalysts, alkaline and alkaline-earth metal catalysts (e.g., carboxylates of alkali and alkaline-earth metals such as lithium acetate, sodium acetate, potassium acetate, calcium acetate, sodium benzoate, potassium benzoate), and zinc acetate. The amount of each of these catalysts is preferably from 0 to 0.6% by weight based on the resultant polymer. In this case, the catalyst does not adversely affect the color of the resultant polyester resin. Such a resultant polyester resin is preferably used for full-color toners. The amount of the titanium-containing catalyst (a) is preferably from 50 to 100% by weight based on all the catalysts.

The linear polyester resin (AX1) is obtainable as follows, for example. The diol (g) and the dicarboxylic acid (i) are heated to a temperature of from 180 to 260° C. in the presence of the titanium-containing catalyst (a) in an amount of from 0.0001 to 0.8% by weight based on the resultant polymer, optionally in combination with other catalysts, at normal or reduced pressures, so that a dehydration condensation is performed.

The non-linear polyester resin (AX2) is obtainable as follows, for example. The diol (g), the dicarboxylic acid (i), and the polyol (h) having 3 or more valences are heated to a temperature of from 180 to 260° C. in the presence of the titanium-containing catalyst (a) in an amount of from 0.0001 to 0.8% by weight based on the resultant polymer, optionally in combination with other catalysts, at normal or reduced pressures, so that a dehydration condensation is performed. Subsequently, the polycarboxylic acid (j) having 3 or more valences is further reacted.

Alternatively, the diol (g), dicarboxylic acid (i), polyol (h) having 3 or more valences, and polycarboxylic acid (j) having 3 or more valences are reacted simultaneously.

The modified polyester resin (AY1) is obtainable as follows, for example. The non-linear polyester resin (AX2) and the polyepoxide (c) are heated to a temperature of from 180 to 260° C. so that a molecular elongation reaction is performed.

The non-linear polyester resin (AX2), which is to be reacted with the polyepoxide (c), preferably has an acid value of from 1 to 60 mgKOH/g, and more preferably from 5 to 50 mgKOH/g. When the acid value is 1 or more, unreacted polyepoxide (c) hardly remains, and therefore the resultant resin may not be adversely affected. When the acid value is 60 or less, the resultant resin has good thermal stability.

From the viewpoint of improving low-temperature fixability and hot offset resistance, the amount of the polyepoxide (c) needed for obtaining the modified polyester resin (AY1) is preferably from 0.01 to 10% by weight, and more preferably from 0.05 to 5% by weight, based on the non-linear polyester resin (AX2).

The amorphous resins for use in the present invention may include resins other than the polyester resins.

Specific examples of usable amorphous resins other than the polyester resins include, but are not limited to, styrene resins (e.g., styrene-alkyl(meth)acrylate copolymer, styrene-diene monomer copolymer), epoxy resins (e.g., ring-opening polymerization products of bisphenol A diglycidyl ether), and urethane resins (e.g., polyaddition products of a diol and/or a polyol having 3 or more valences with a diisocyanate).

The amorphous resins preferably include resins other than the polyester resins in an amount of from 0 to 40% by weight, more preferably from 0 to 30% by weight, and much more preferably from 0 to 20% by weight, based on all the amorphous resins.

The crystalline polyester resin for use in the present invention is a crystalline aliphatic polyester resin including an ester bond represented by the following formula (I) in an amount of 60% by mole or more in a main chain thereof;

$$—OCO—R—COO—(CH_2)_n— \quad (I)$$

wherein R represents a residue group of a straight-chain unsaturated aliphatic divalent carboxylic acid such as a straight-chain unsaturated aliphatic group having 2 to 20, preferably 2 to 4, carbon atoms; and n represents an integer of from 2 to 6.

Whether or not a resin includes the structure of the formula (I) can be determined by solid $C^{13}$ NMR.

The straight-chain unsaturated aliphatic group may be derived from straight-chain unsaturated divalent carboxylic acids such as maleic acid, fumaric acid, 1,3-n-propenedicarboxylic acid, and 1,4-n-butenedicarboxylic acid, but is not limited thereto.

In the formula (I), $(CH_2)_n$ represents a residue group of a straight-chain aliphatic divalent alcohol. The residue group of a straight-chain aliphatic divalent alcohol may be derived from straight-chain aliphatic divalent alcohols such as ethylene glycol, 1,3-propylene glycol, 1,4-butanediol, and 1,6-hexanediol, but is not limited thereto.

As described above, the crystalline polyester resin includes a straight-chain unsaturated aliphatic dicarboxylic acid unit, thereby easily forming a crystalline structure compared to that including an aromatic dicarboxylic acid unit.

The crystalline polyester resin is obtainable by a typical polycondensation reaction between (i) polyvalent carboxylic acid components including a straight-chain unsaturated aliphatic divalent carboxylic acid and/or a derivative (e.g. an acid anhydride, a lower alkyl ester having 1 to 4 carbon atoms, an acid halide) thereof and (ii) polyvalent alcohol components including a straight-chain aliphatic diol.

The polyvalent carboxylic acid components may optionally include a small amount of other polyvalent carboxylic acids. Specific examples of such polyvalent carboxylic acids include (i) an unsaturated aliphatic divalent carboxylic acid having a branched chain, (ii) a saturated aliphatic polyvalent carboxylic acid such as a saturated aliphatic divalent carboxylic acid and a saturated aliphatic trivalent carboxylic acid, and/or (iii) an aromatic polyvalent carboxylic acid such as an aromatic divalent carboxylic acid and an aromatic trivalent carboxylic acid. The polyvalent carboxylic acid is typically added in an amount of 30% by mole or less, and preferably 10% by mole or less, based on all the carboxylic acids, so long as the resultant polyester resin has crystallinity.

Specific examples of usable polyvalent carboxylic acids which may be optionally added include, but are not limited to, divalent carboxylic acids (e.g., malonic acid, succinic acid, glutaric acid, adipic acid, suberic acid, sebacic acid, citraconic acid, phthalic acid, isophthalic acid, terephthalic acid), and polyvalent carboxylic acids having 3 or more valences (e.g., trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid).

The polyvalent alcohol components may optionally include a small amount of an aliphatic branched-chain divalent alcohol, a cyclic divalent alcohol, and/or a polyvalent alcohol having 3 or more valences. Such a polyvalent alcohol is typically added in an amount of 30% by mole or less, and preferably 10% by mole or less, based on all the alcohols, so long as the resultant polyester resin has crystallinity.

Specific examples of usable polyvalent alcohols which may be optionally added include, but are not limited to, 1,4-bis(hydroxymethyl)cyclohexane, polyethyleneglycol, ethylene oxide adduct of bisphenol A, propylene oxide adduct of bisphenol A, and glycerin.

From the viewpoint of improving low-temperature fixability, the molecular weight distribution of the crystalline polyester resin is preferably as narrow as possible, and molecular weight thereof is preferably as small as possible. The crystalline polyester resin preferably has a weight average molecular weight (Mw) of from 5500 to 6500, a number average molecular weight (Mn) of from 1300 to 1500, and a ratio Mw/Mn of from 2 to 5, determined from a molecular distribution chart measured by gel permeation chromatography (GPC) based on o-Dichlorobenzene soluble components thereof.

The molecular weight distribution chart has a lateral axis indicating log M (M represents a molecular weight) and a vertical axis indicating ratio (% by weight). The molecular weight distribution chart of the crystalline polyester resin preferably has a peak in a range of from 3.5 to 4.0% by weight. In addition, the half bandwidth of the peak is preferably 1.5 or less.

The glass transition temperature (Tg) and softening point ($T(F_{1/2})$) each are preferably as low as possible, so long as the resultant toner has good thermostable preservability. The crystalline polyester resin typically has a Tg of from 100 to 150° C., and preferably from 110 to 140° C. The crystalline polyester resin typically has a $T(F_{1/2})$ of from 100 to 150° C., and preferably from 110 to 140° C. When Tg and $T(F_{1/2})$ are too high, low-temperature fixability of the resultant toner may deteriorate.

Whether or not a polyester resin has crystallinity can be determined from existence or nonexistence of peaks in an X-ray diffraction pattern measured by a powder X-ray diffractometer. Preferably, an X-ray diffraction pattern of the crystalline polyester resin for use in the present invention has a peak in a range of from 20° to 25°, and more preferably, peaks in ranges of (i) from 19° to 21°, (ii) from 21° to 23°, (iii) from 23° to 25°, and (iv) from 25° to 28°, as diffraction peaks of Bragg angles 2θ.

Figure 5:
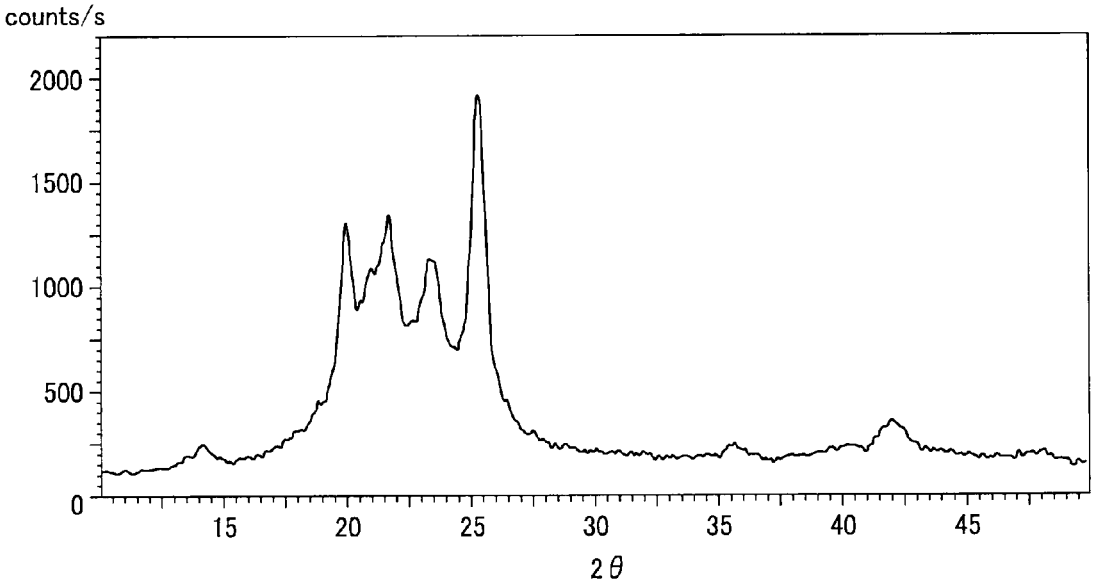
FIG. 5 is an X-ray diffraction chart of a crystalline polyester.
Figure 6:
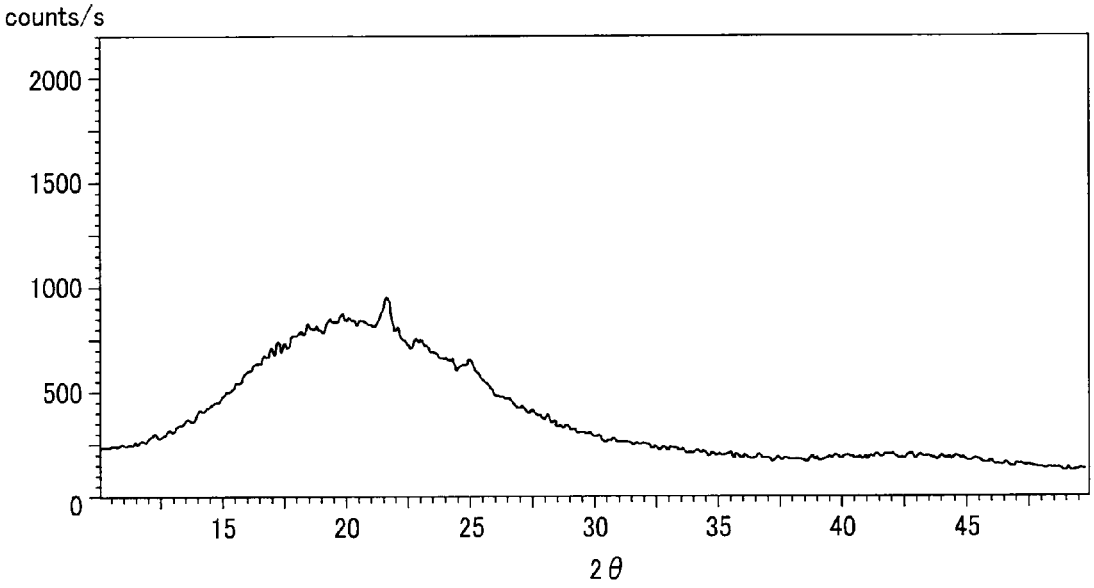
FIG. 6 is an X-ray diffraction chart of an exemplary toner of the present invention.

As the powder X-ray diffractometer, RINT 1100 (from Rigaku Corporation) can be used, for example. A measurement is performed under the following conditions using a wide-angle goniometer: X-ray tube is Cu, voltage is 50 kV, and current is 30 mA. FIG. 5 is an X-ray diffraction chart of the crystalline polyester and FIG. 6 is an X-ray diffraction chart of the toner for use in the present invention.

When 2 or more polyester resins are used in combination, or one polyester resin is mixed with another resin, the resins in powder state may be mixed (hereinafter "powder mixing") or the melted resins may be mixed (hereinafter "melt mixing"). Alternatively, the resins may be mixed at a time a toner is formed.

In the melt mixing, the melting temperature is preferably from 80 to 180° C., more preferably from 100 to 170° C., and much more preferably from 120 to 160° C. When the melting temperature is too low, the resins may be unevenly mixed. When the melting temperature is too high especially when 2 or more polyester resins are used in combination, ester-exchange reaction may occur between the 2 or more polyester resins. Consequently, the polyester resins cannot keep desirable properties for serving as binder resins.

In melt mixing, the mixing time is preferably from 10 seconds to 30 minutes, more preferably from 20 seconds to 10 minutes, and much more preferably from 30 seconds to 5 minutes. When the mixing time is too long especially when 2 or more polyester resins are used in combination, ester-exchange reaction may occur between the 2 or more polyester resins. Consequently, the polyester resins cannot keep desirable properties for serving as binder resins.

In melt mixing, both batch-type mixers including a reaction vessel and continuous mixers can be used. To evenly mix resins in a shorter time at a proper temperature, continuous mixers such as an extruder, a continuous kneader, and a three-roll mill are preferably used. Among these mixers, an extruder and a continuous kneader are more preferably used.

In powder mixing, typical mixers can be used under typical mixing conditions. For example, the mixing temperature is preferably from 0 to 80° C., and more preferably from 10 to 60° C. The mixing time is preferably 3 minutes or more, and more preferably from 5 to 60 minutes. Specific examples of usable mixers in the powder mixing include, but are not limited to, a HENSCHEL MIXER, a NAUTER MIXER, and a BANBURY MIXER. Among these mixers, a HENSCHEL MIXER is preferably used.

The crystalline polyester resin preferably has an acid value of 10 mgKOH/g or more so that the resultant toner has good affinity to paper and low-temperature fixability. On the other hand, the crystalline polyester resin preferably has an acid value of 45 mgKOH/g or less so that the resultant toner has good hot offset resistance.

The crystalline polyester resin preferably has a hydroxyl value of from 5 to 60 mgKOH/g so that the resultant toner has good low-temperature fixability and chargeability.

Any known waxes can be used in the present invention such as low-molecular-weight polyolefin waxes (e.g., low-molecular-weight polyethylene, low-molecular-weight polypropylene), synthesized hydrocarbon waxes (e.g., Fisher-Tropsch wax), natural waxes (e.g., beeswax, carnauba wax, candelilla wax, rice wax, montan wax), petroleum waxes (e.g., paraffin wax, microcrystalline wax), higher aliphatic acids (e.g., stearic acid, palmitic acid, myristic acid) and metal salts thereof, higher aliphatic acid amids, synthesized ester waxes, and the above-described waxes which are modified.

Among these waxes, carnauba wax and modified waxes thereof, polyethylene wax, and synthesized ester wax are preferably used. Specifically, carnauba wax is most preferably used. These waxes can be finely dispersed in polyester or polyol resins, and therefore the resultant toner may have a good combination of hot offset resistance, transferability, and durability.

These waxes can be used alone or in combination.

The toner preferably includes the wax in an amount of from 2 to 15% by weight. When the amount is too small, hot offset resistance of the resultant toner may be poor. When the amount is too large, transferability and durability of the resultant toner may be poor.

The wax preferably has a melting point of from 70 to 155° C. When the melting point is too low, thermostable preservability of the resultant toner may deteriorate. When the melting point is too high, the resultant toner may not sufficiently express releasability.

When the toner includes an aliphatic acid amide compound as the wax, fixability of the toner drastically improves. It is considered that when part of a silicone oil applied to a fixing roller adheres to a surface of an image, the aliphatic acid amide compound prevents the silicone oil from immersing into the image. As a result, the silicone oil is capable of staying on the surface of the image for a longer time. Accordingly, the image becomes resistant to abrasion, providing consistent fixability.

Users of high-speed systems having a linear velocity of from 500 to 1700 mm/sec, such as users of roll papers, require an improved fixability immediately after an image is fixed. Therefore, the toner for use in the present invention preferably includes an aliphatic acid amide compound.

As the aliphatic acid amide compound, a compound represented by the formula $R_1$—CO—$NR_2R_3$ is preferably used. $R_1$ represents an aliphatic hydrocarbon group having 10 to 30 carbon atoms. Each of $R_2$ and $R_3$ independently represents a hydrogen atom, an alkyl group having 1 to 10 carbon atoms, an aryl group having 6 to 10 carbon atoms, or an aralkyl group having 7 to 10 carbon atoms. The alkyl, aryl, and aralkyl groups may be substituted with an inert substituent such as a fluorine atom, a chlorine atom, a cyano group, an alkoxy group, and an alkylthio group. However, the alkyl, aryl, and aralkyl groups are preferably unsubstituted.

Specific preferred examples of usable aliphatic acid amide compound include, but are not limited to, bisstearic acid amide, stearic acid amide, stearic acid methylamide, stearic acid diethylamide, stearic acid benzylamide, stearic acid phenylamide, behenic acid amide, behenic acid dimethylamide, myristic acid amide, and palmitic acid amide.

Among these compounds, alkylenebis aliphatic acid amides are preferably used. Specifically, compounds having the following formula (II) are preferably used:

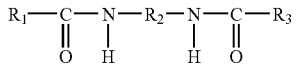

(II)

wherein each of $R_1$ and $R_3$ independently represents an alkyl or alkenyl group having 5 to 21 carbon atoms, and $R_2$ represents an alkylene group having 1 to 20 carbon atoms.

Specific examples of the alkylenebis saturated aliphatic acid amides having the formula (II) include, but are not limited to, methylenebis stearic acid amide, ethylenebis stearic acid amide, methylenebis palmitic acid amide, ethylenebis palmitic acid amide, methylenebis behenic acid amide, ethylenebis behenic acid amide, hexamethylenebis stearic acid amide, hexaethylenebis palmitic acid amide, and hexamethylenebis behenic acid amide. Among these compounds, ethylenebis stearic acid amide is most preferably used.

When the softening point (Tm(Tsp)) of the aliphatic acid amide compound is lower than the surface temperature (TH) of a fixing member, the aliphatic acid amide may reliably function as the wax.

Specific preferred examples of usable aliphatic acid amide compounds further include alkylenebis aliphatic acid amide compounds of saturated or unsaturated monovalent or divalent aliphatic acids, such as propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amide, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosenoic acid amide, ethylenebis eicosenoic acid amide, propylenebis eicosenoic acid amide, butylenebis eicosenoic acid amide, methylenebis behenic acid amide, ethylenebis behenic acid amide, propylenebis behenic acid amide, butylenebis behenic acid amide, methylenebis erucic acid amide, ethylenebis erucic acid amide, propylenebis erucic acid amide, and butylenebis erucic acid amide.

The toner for use in the present invention preferably includes at least one aliphatic acid amide compound, and more preferably further includes a wax other than the aliphatic acid amide compound.

In the present invention, an external additive such as a particulate resin and a particulate inorganic material (e.g., silica, titanium oxide, alumina, silicon carbide, silicon nitride, boron nitride) is externally added to a mother toner. The external additive has a function of improving transferability and durability of the toner and scraping off undesirable toner films formed on the image bearing member 1.

The external additive covers over the wax, which may degrade transferability and durability, at the surface of the mother toner and reduces a contact area of the mother toner, thereby improving transferability and durability of the toner.

The surface of the particulate inorganic material is preferably hydrophobized. For example, hydrophobized metal oxides such as silica and titanium oxide are preferably used. As the particulate resin, fine particles of a polymethyl methacrylate and/or polystyrene having an average diameter of about from 0.05 to 1 μm obtainable by a soap-free emulsion polymerization are preferably used. A combination of a smaller amount of a hydrophobized silica and a larger amount of a hydrophobized titanium oxide is preferable because of having good charge stability regardless of humidity.

In combination with the above-described particulate inorganic material, an external additive having a larger particle diameter (hereinafter "large-sized external additive") than typical external additives, such as a silica having a specific surface area of from 20 to 50 $m^2/g$ and a particulate resin having an average particle diameter of from 1/100 to 1/8 that of the toner, is preferably used, because durability of the toner further improves.

When a typical toner including a typical-sized external additive and no large-sized external additive is mixed and agitated with a carrier in a developing deice, the typical-sized external additive tends to be buried in the mother toner, resulting in poor durability. By externally adding a large-sized external additive, the typical-sized external additive, which is relatively smaller than the large-sized external additive, is prevented from being buried in the mother toner, resulting in improved durability.

When the above-described particulate material is internally added to the toner, pulverization property of the toner improves in addition to transferability and durability, although degree of improvement of transferability and durability slightly decreases. When the above-described particulate material is both externally and internally added to the toner, the externally added particulate material is prevented from being buried in the mother toner, thereby providing reliable transferability and durability.

Specific examples of usable hydrophobizing agents include, but are not limited to, dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinyltrimethoxysilane, vinyl-tris(β-methoxyethoxy) silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane. Further, titanate coupling agents and aluminum coupling agents can also be used.

In addition to the above-described materials, aliphatic metal salts, fine particles of polyvinylidene fluoride, and the like, can be externally added to the mother toner so that the toner has an improved cleanability.

The toner of the present invention may include a colorant. Any known pigments and dyes can be used as the colorant for yellow, magenta, cyan, and black toners in the present invention.

Specific examples of yellow colorants include, but are not limited to, Cadmium Yellow, Pigment Yellow 155, Benzimidazolone, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOW NCG, and Tartrazine Lake.

Specific examples of orange colorants include, but are not limited to, molybdenium orange, PERMANENT ORANGE GTR, pyrazolone orange, vulcan orange, INDANTHRENE BRILLIANT ORANGE RK and GK, and Benzidine Orange G.

Specific examples of red colorants include, but are not limited to, red iron oxide, Quinacridone Red, cadmium red, PERMANENT RED 4R, Lithol Red, Pyrazolone Red, Lake Red D, Brilliant Carmine 6B, Eosin Lake, Rhodamine Lake B, Alizarine Lake, and Brilliant Carmine 3B.

Specific examples of violet colorants include, but are not limited to, Fast Violet B and Methyl Violet Lake.

Specific examples of the blue colorants include, but are not limited to, cobalt blue, Alkali Blue, Victoria Blue Lake, Phthalocyanine Blue, metal-free Phthalocyanine Blue, partially-chlorinated Phthalocyanine Blue, Fast Sky Blue, and INDANTHRENE BLUE BC.

Specific examples of green colorants include, but are not limited to, Chrome Green, chromium oxide, Pigment Green B, and Malachite Green Lake.

Specific examples of black colorants include, but are not limited to, azine dyes (e.g., carbon black, oil furnace black, channel black, lamp black, acetylene black, aniline black), metal salt azo dyes, metal oxides, and combined metal oxides.

These can be used alone or in a combination.

The toner of the preset invention may optionally include a charge controlling agent. Specific examples of usable charge controlling agents include, but are not limited to, azine dyes having an alkyl group having 2 to 16 carbon atoms disclosed in Examined Japanese Patent Application Publication No. (hereinafter "JP-B") 42-1627; basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000); lake pigments of the basic dyes; C. I. Solvent Black 8 (C. I. 26150); quaternary ammonium salts such as benzoyl methyl hexadecyl ammonium chloride and decyl trimethyl chloride; dialkyltin compounds such as dibutyltin and dioctyltin; dialkyltin borate compounds, guanidine derivatives; polyamine resins such as vinyl polymers having amino group and condensation polymers having amino group; metal complexes of monoazo dyes disclosed in JP-Bs 41-20153, 43-27596, 44-6397, and 45-26478; metal complexes of salicylic acid, dialkyl salicylic acid, naphthoic acid, and dicarboxylic acid with Zn, Al, Co, Cr, and Fe, disclosed in JP-Bs 55-42752 and 59-7385; sulfonated copper phthalocyanine pigments; organic boric salts; quaternary ammonium salts containing fluorine; and calixarene compounds. Needless to say, whitish materials such as metal salts of salicylic acid derivatives are preferably used for full-color toners other than black toners so as not to degrade the desired color tone.

The toner of the present invention is obtainable by any known method such as a melt-kneading pulverization method, a polymerization method, a polyaddition method using a prepolymer having an isocyanate group, a method including steps of dissolving toner components in a solvent, removing the solvent, and pulverizing the toner components, a melt-spraying method, and the like. Specifically, the toner of the present invention is preferably obtained by a melt-kneading method, a polymerization method (e.g., suspension polymerization method, emulsion aggregation polymerization method) in which compositions including a specific crystalline polymer and a monomer are directly polymerized in an aqueous medium, a polyaddition method in which compositions including a specific crystalline polymer and a prepolymer having an isocyanate group are directly elongated and/or cross-linked with an amine in an aqueous medium, or a method in which toner components are dissolved in a solvent, the solvent is removed therefrom, and the toner components are pulverized.

Specific examples of usable kneaders for melt-kneading toner components include, but are not limited to, a batch-type double-roll mill; a BANBURY MIXER; continuous double-axis extruders such as TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., and KEX EXTRUDER from Kurimoto, Ltd.; and continuous single-axis extruders such as KOKNEADER from Buss Corporation, etc.

In the polymerization method and the polyaddition method using a prepolymer having an isocyanate group, an emulsification process is needed to form liquid droplets by forcibly applying mechanical energy to the aqueous medium. The mechanical energy can be applied using a HOMOMIXER, an ultrasonic disperser, a MANTON GAULIN HOMOGENIZER, and the like, which are capable of strongly agitating or giving an ultrasonic vibration energy.

In the pulverization process, toner components are coarsely pulverized using a HAMMER MILL, a ROTOPLEX, and the like, and then finely pulverized using a pulverizer using jet stream, a mechanical pulverizer, and the like. The pulverized particles preferably have an average particle diameter of from 3 to 15 μm. Further, the pulverized particles are classified using a wind power classifier so as to adjust the average particle diameter to from 5 to 20 μm.

An external additive is externally added to a mother toner by mixing the mother toner and the external additive using a mixer, while pulverizing the external additive. It is important that particles of the external additive are evenly and strongly adhered to the mother toner so as to improve durability of the toner.

Preferably, a developer for use in the present invention is a two-component developer including a toner and a carrier. Any known carrier can be used, such as iron powders, ferrite powders, magnetite powders, nickel powders, and glass beads. The surfaces of these materials may be covered with a resin, and the like. The carrier preferably has a volume average particle diameter of from 25 to 200 μm.

A container for use in the present invention contains the toner of the present invention or a developer including the toner and a carrier.

Any known container can be used. Suitable containers may include a main body and a cap.

The container is not limited in size, shape, structure, material, and the like. The container preferably has a cylindrical shape having spiral projections and depressions on the inner surface thereof. Such a container can feed the toner or developer to an ejection opening by rotation. It is more preferable that a part or all of the spiral parts of such a container have a structure like an accordion.

Suitable materials used for the container include materials having good dimensional accuracy. Specifically, resins are preferably used. Specific preferred examples of usable resins for the container include, but are not limited to, polyester resins, polyethylene resins, polypropylene resins, polystyrene resins, polyvinylchloride resins, polyacrylic acids, polycarbonate resins, ABS resins, and polyacetal resins.

The container is preferably easily storable, transportable, and treatable. Further, the container is preferably detachable from a process cartridge and an image forming apparatus to feed the toner or developer thereto.

A process cartridge for use in the present invention integrally supports at least one of a developing device containing the developer, an image bearing member, a charging device, and a cleaning device. The process cartridge is detachably attachable to an image forming apparatus. The process cartridge may further integrally support any known device such as a decharging device.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Crystalline Polyester Resin

In a 5-liter four-necked flask equipped with a nitrogen inlet pipe, a dehydration pipe, a stirrer, and a thermocouple, 25 mol of 1,4-butanediol, 23.75 mol of fumaric acid, 1.65 mol of trimellitic anhydride, and 5.3 g of hydroquinone were contained, and reacted for 5 hours at 160° C. Subsequently, the mixture was heated to 200° C. and reacted for 1 hour, and further reacted for 1 hour at 8.3 kPa. Thus, a crystalline polyester resin (1) was prepared.

FIG. 5 is an X-ray diffraction chart of the crystalline polyester (1). It is apparent from FIG. 5 that the crystalline polyester resin (1) includes an ester bond represented by the following formula (III) in a main chain thereof:

$$—OCO—CH{=}CH—COO—(CH_2)_n— \quad \text{(III)}$$

The evaluation results of the crystalline polyester resin (1) are shown in Table 1.

TABLE 1

| | $T(F_{1/2})$ (° C.) | Tg (° C.) | Acid value (mgKOH/g) | Hydroxyl value (mgKOH/g) |
|---|---|---|---|---|
| Crystalline polyester resin (1) | 131 | 131 | 15 | 53 |

The softening point $T(F_{1/2})$ was measured using a flowtester CFT-500D capillary rheometer from Shimadzu Corporation. The measurement conditions were as follows:

Load: 30 kg/cm2

Heating rate: 3.0° C./min

Die orifice: 0.50 mm

Die length: 1.0 mm

The glass transition temperature (Tg) was measured using a TG-DSC system TAS-100 from Rigaku Corporation. First, about 10 mg of a sample were contained in an aluminum sample container. The container was placed on a holder unit and set in an electric furnace, and heated from 25 to 180° C. at a heating rate of 10° C./min. The glass transition temperature (Tg) was calculated from an intersection point of a tangent line of an endothermic curve adjacent to the glass transition temperature (Tg) and a base line using an analysis system in the TAS-100 system.

The acid and hydroxyl values were measured by a method according to JIS K 0070. When a sample was insoluble in the solvent, dioxane, THF, oro-dichlorobenzene, and the like solvent were used as the solvent.

Synthesis of Amorphous Polyester Resin (Synthesis of Titanium-Containing Catalyst)

In a reaction vessel equipped with a condenser, a stirrer, and a nitrogen inlet pipe capable of bubbling liquid, a 80% aqueous solution of titanium dihydroxybis(triethanolaminate) was contained and gradually heated to 90° C. while being bubbled with nitrogen, and subsequently subjected to a hydrolysis reaction for 4 hours at 90° C. Thus, titanium terephthalate serving as a titanium-containing catalyst (A1) was prepared.

(Synthesis of Linear Polyester Resin (AX1-1))

In a reaction vessel equipped with a condenser, a stirrer, and a nitrogen inlet pipe, 430 parts of PO 2 mol adduct of bisphenol A, 300 parts of PO 3 mol adduct of bisphenol A, 257 parts of terephthalic acid, 65 parts of isophthalic acid, 10 parts of maleic anhydride, and 2 parts of the titanium-containing catalyst (A1) serving as a condensation catalyst were contained, and reacted for 10 hours at 220° C. under nitrogen gas flow while removing produced water. Subsequently, the mixture was reacted under a reduced pressure of from 5 to 20 mmHg until the reaction product had an acid value of 5. The reaction product was cooled to room temperature and pulverized. Thus, a linear polyester resin (AX1-1) was prepared.

The linear polyester resin (AX1-1) includes no THF-insoluble components, and has an acid value of 7, a hydroxyl value of 12, a glass transition temperature (Tg) of 60° C., a number average molecular weight (Mn) of 6940, and a peak molecular weight (Mp) of 19100. The linear polyester resin (AX1-1) includes components having a molecular weight of 1500 or less in an amount of 1.2%. Here, the peak molecular weight (Mp) represents a molecular weight at which a main peak is observed in a molecular weight distribution chart with a lateral axis indicating molecular weight and a vertical axis indicating frequency.

(Synthesis of Non-Linear Polyester Resin (AX2-1))

In a reaction vessel equipped with a condenser, a stirrer, and a nitrogen inlet pipe, 350 parts of EO 2 mol adduct of bisphenol A, 326 parts of PO 3 mol adduct of bisphenol A, 278 parts of terephthalic acid, 40 parts of phthalic anhydride, and 2 parts of the titanium-containing catalyst (A1) serving as a condensation catalyst were contained, and reacted for 10 hours at 230° C. under nitrogen gas flow while removing produced water. Subsequently, the mixture was reacted under a reduced pressure of from 5 to 20 mmHg until the reaction product had an acid value of 2 or less, and cooled to 180° C. Further, 62 parts of trimellitic anhydride were added thereto, and the mixture was hermetically reacted for 2 hours at normal pressures. The reaction product was cooled to room temperature and pulverized. Thus, a non-linear polyester resin (AX2-1) was prepared.

The non-linear polyester resin (AX2-1) includes no THF-insoluble components, and has an acid value of 35, a hydroxyl value of 17, a glass transition temperature (Tg) of 69° C., a number average molecular weight (Mn) of 3920, and a peak molecular weight (Mp) of 11200. The non-linear polyester resin (AX2-1) includes components having a molecular weight of 1500 or less in an amount of 0.9%.

(Synthesis of Amorphous Polyester Resin (A))

First, 400 parts of the linear polyester resin (AX1-1) and 600 parts of the non-linear polyester resin (AX2-1) were melt-kneaded using a continuous kneader at a jacket temperature of 150° C. and a residence time of 3 minutes, to prepare a melted resin composition. The melted resin composition was then cooled to 30° C. over a period of 4 minutes using a steel belt cooling device, followed by pulverization. Thus, an amorphous polyester resin (A) was prepared.

Example 1

The following components were evenly mixed using a blender.

| | |
|---|---|
| Crystalline polyester resin (1) | 4 parts |
| Amorphous Polyester resin (A) | 96 parts |
| Polypropylene wax (melting point: 151° C.) | 5 parts |
| Charge controlling agent (Metal salt of salicylic acid derivative) | 2 parts |
| Colorant (Copper phthalocyanine pigment) | 6 parts |
| Ethylenebis stearic acid amide (melting point: 115° C.) | 5 parts |

The mixture was melt-kneaded using a double-axis extruder at a kneading temperature of 140° C., an extruding speed of 10 kg/h, and a rolling gap of 2 mm. The rolled mixture was allowed to stand for 72 hours before being pulverized and classified. Thus, a mother toner having a volume average particle diameter of 7.6 μm was prepared. Next, 100 parts of the mother toner were mixed with 0.4 parts of a hydrophobized silica (which is surface-treated with hexamethyldisilazane, having an average particle diameter of 0.02 μm) for 60 seconds using a HENSCHEL MIXER at a revolution of 1500 rpm, followed by pause for 60 seconds. This mixing operation was repeated for 8 times. Thus, a cyan toner was prepared.

Example 2

The procedure for preparation of the toner in Example 1 was repeated except that the kneading temperature was changed to 120° C., the extruding speed was changed to 5 kg/h, the rolling gap was changed to 1.5 mm, and the propylene wax was replaced with a carnauba wax having a melting point of 80° C.

Example 3

The procedure for preparation of the toner in Example 1 was repeated except that the kneading temperature was changed to 160° C., the extruding speed was changed to 15 kg/h, the rolling gap was changed to 2.5 mm, and the propylene wax was replaced with a carnauba wax having a melting point of 80° C.

Example 4

The procedure for preparation of the toner in Example 2 was repeated except that the amount of the hydrophobized silica was changed from 0.40 parts to 0.30 parts.

Example 5

The procedure for preparation of the toner in Example 3 was repeated except that the amount of the hydrophobized silica was changed from 0.40 parts to 0.55 parts.

Example 6

The procedure for preparation of the toner in Example 3 was repeated except that the kneading temperature was changed to 170° C., the extruding speed was changed to 20 kg/h, the rolling gap was changed to 3.0 mm, and the amount of the carnauba wax was changed from 5 parts to 8 parts.

Comparative Example 1

The procedure for preparation of the toner in Example 1 was repeated except that the time in which the rolled mixture was allowed to stand before being pulverized and classified was changed from 72 hours to 48 hours.

Comparative Example 2

The procedure for preparation of the toner in Example 6 was repeated except that the time in which the rolled mixture was allowed to stand before being pulverized and classified was changed from 72 hours to 84 hours.

Comparative Example 3

The procedure for preparation of the toner in Comparative Example 1 was repeated except that the amount of the hydrophobized silica was changed from 0.40 parts to 0.27 parts.

Comparative Example 4

The procedure for preparation of the toner in Comparative Example 2 was repeated except that the amount of the hydrophobized silica was changed from 0.40 parts to 0.60 parts.

Evaluations

The toners prepared above were subjected to the following evaluations.

(1) Measurement of C/R and W/R

Each of C/R and W/R represents a height ratio of a peak specific to the crystalline polyester resin and the wax, respectively, to that specific to the amorphous resin, in an absorbance spectrum measured by an ATR (total reflection) method using a FT-IR (Fourier transform infrared) apparatus AVATAR 370 from Thermo Electron Corporation. Since the ATR method requires a measuring target to have a smooth surface, a toner needs to be pelletized before the measurement. Specifically, 2.0 g of a toner was formed into a pellet having a diameter of 20 mm by being compressed with a load of 1 t for 60 seconds.

For example, in a preferred embodiment, C represents a height of an absorbance peak specific to the crystalline polyester in a crystalline state observed at a wavenumber of 1165 $cm^{-1}$, a baseline of which is drawn from 1137 to 1199 $cm^{-1}$, as shown in FIG. 2. In a preferred embodiment, W represents a height of an absorbance peak originated from C—H stretching of alkyl chains in the wax observed at a wavenumber of 2850 $cm^{-1}$, a baseline of which is drawn from 2834 to 2862 $cm^{-1}$. In a preferred embodiment, R represents a height of an absorbance peak specific to the amorphous resin. When the amorphous resin is a polyester resin, the absorbance peak is observed at a wavenumber of 829 $cm^{-1}$, a baseline of which is drawn from 784 to 889 $cm^{-1}$, as shown in FIG. 3. In a different preferred embodiment, when the amorphous resin is a styrene-acrylic resin, the absorbance peak is observed at a wavenumber of 699 $cm^{-1}$, a baseline of which is drawn from 670 to 714 $cm^{-1}$, as shown in FIG. 4. C/R and W/R were calculated from the measured values of C, W, and R.

(2) Measurement of Amount of External Additive

A calibration curve of the external additive, i.e., silica in the Examples, was previously prepared by a fluorescent X-ray method using samples each including various amounts of silica, to make an application for detecting the amount of silica of a sample. The amount of silica is represented by weight ratio in parts based on 100 parts of a mother toner.

(3) Evaluation of Image Quality

First, 132.2 parts of a silicone resin solution (including solid components in an amount of 23% by weight, SR2410 from Dow Corning Toray Co., Ltd.), 0.66 parts of an aminosilane (including solid components in an amount of 100% by weight, SH6020 from Dow Corning Toray Co., Ltd.), 31 parts of a particulate conductive material (1) (including a substrate made of alumina, a lower surface layer made of tin dioxide, and an upper surface layer made of indium oxide including tin dioxide; having a particle diameter of 0.35 μm and a specific resistance of 3.5 Ω·cm), and 300 parts of toluene were mixed for 10 minutes using a HOMOMIXER to prepare a cover layer coating liquid. The cover layer coating liquid was applied to the surface of a calcined ferrite powder having a volume average particle diameter of 70 μm, serving as a core, using SPIRA COTA® (from Okada Seiko Co., Ltd.) at an inner temperature of 40° C., followed by drying, so that a cover layer having a thickness of 0.15 μm was formed thereon. The core thus coated was then calcined in an electric furnace for 1 hour at 300° C., and subsequently cooled and pulverized using a sieve having openings of 125 μm. Thus, a carrier (1) was prepared.

To prepare a two-component developer, 4% by weight of each of the above-prepared toners and 96% by weight of the carrier (1) were mixed. The two-component developer thus prepared was set in a modified image forming apparatus shown in FIG. 1, and 50,000 sheets of an image per day were produced. At times when initial and $100{,}000^{th}$ images were produced, respectively, 3 sheets of an A3-size black solid image were produced so as to visually observe whether or not undesirable white spots were caused, corresponding to portions where toner films were formed on the image bearing member 1.

In the modified image forming apparatus, a system speed was set to 1700 mm/sec, a developing gap was set to 1.26 mm, a doctor blade gap was set to 1.6 mm, and a transfer current was set to 1.6 mA.

The system speed was calculated from the following equation:

$$B\ (\text{mm/sec}) = 100\ (\text{sheets}) \times 297\ (\text{mm}) / A\ (\text{sec})$$

wherein A represents a time (sec) for continuously outputting 100 sheets of A4-size paper (having a vertical length of 297 mm) in a vertical direction and B represents a system speed (mm/sec).

The produced image was visually observed to evaluate the amount of white spots, and graded as follows.

A: The amount of white spots was very small. Very good.

B: The amount of white spots was small. Good.

C: The amount of white spots was average.

D: The amount of white spots was very large.

(4) Evaluation of Low-Temperature Fixability

Each of the two-component developers prepared above was set in a modified copier IMAGIO NEO C600 (from Ricoh Co., Ltd.) from which an oil applicator was removed. The system speed was set to 1700 mm/sec. A minimum fixable temperature was determined by changing the temperature of a fixing roller at a decrement of 5° C., while no oil was applied to the fixing roller. As a transfer paper, a PPC paper TYPE 6200 (from Ricoh Co., Ltd.) was used.

A copy image having an image density of 1.2 was produced at each temperatures of the fixing roller. The copy image was smeared for 10 times with a sand eraser using a crock meter. The image density was measured before and after the copy image was smeared. A fixing ratio was calculated from the following equation:

$$\text{Fixing Ratio (\%)}=\text{ID(after)}/\text{ID(before)}\times 100$$

The minimum fixable temperature was defined as a temperature below which the fixing ratio was less than 70%, and graded as follows.

A: The minimum fixable temperature was extremely low.

B: The minimum fixable temperature was very low.

C: The minimum fixable temperature was lower than conventional toners.

D: The minimum fixable temperature was higher than conventional toners.

The evaluation results are shown in Table 2.

TABLE 2

| | C/R | W/R | X | Equation (1) | Image Quality | Minimum Fixable Temperature |
|---|---|---|---|---|---|---|
| Ex. 1 | 0.048 | 0.045 | 0.40 | 0.55 | A | A |
| Ex. 2 | 0.030 | 0.030 | 0.40 | 0.36 | A | B |
| Ex. 3 | 0.070 | 0.054 | 0.40 | 0.75 | A | A |
| Ex. 4 | 0.030 | 0.030 | 0.30 | 0.47 | A | A |
| Ex. 5 | 0.070 | 0.54 | 0.55 | 0.55 | A | A |
| Ex. 6 | 0.150 | 0.070 | 0.30 | 1.85 | B | A |
| Comp. Ex. 1 | 0.035 | 0.022 | 0.40 | 0.35 | A | D |
| Comp. Ex. 2 | 0.150 | 0.072 | 0.30 | 1.86 | D | A |
| Comp. Ex. 3 | 0.035 | 0.022 | 0.27 | 0.52 | D | A |
| Comp. Ex. 4 | 0.150 | 0.072 | 0.60 | 0.93 | D* | D |

*Silica films were observed.

It is apparent from Table 2 that high quality images without white spots are produced at low fixing temperatures in high-speed image forming apparatuses in Examples 1 to 6.

This document claims priority and contains subject matter related to Japanese Patent Applications Nos. 2007-238829 and 2008-192566, filed on Sep. 14, 2007 and Jul. 25, 2008, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming method, comprising:

charging a surface of an image bearing member;

irradiating the charged surface of the image bearing member to form an electrostatic latent image thereon;

developing the electrostatic latent image with a developer comprising a toner to form a toner image;

transferring the toner image onto a recording medium directly or via a transfer member to form an unfixed toner image;

cleaning residual toner particles remaining on the image bearing member; and fixing the unfixed toner image on the recording medium, wherein the toner comprises:

a mother toner comprising a crystalline polyester resin, an amorphous resin, and a wax; and an external additive, wherein the toner satisfies the following equation (1):

$$0.36\leqq(2.77\times C/R+1.97\times W/R)/X\leqq 1.85 \quad (1)$$

wherein each of C, W, and R represents a height of an absorbance peak specific to the crystalline polyester resin, the wax, and the amorphous resin, respectively, measured by a FT-IR ATR method; and X represents an amount (parts by weight) of the external additive.

2. The image forming method according to claim 1, wherein the toner further satisfies the following equation (2):

$$0.36\leqq(2.77\times C/R+1.97\times W/R)/X\leqq 0.75 \quad (2).$$

3. The image forming method according to claim 1, wherein the toner further satisfies the following equation (3):

$$0.03\leqq C/R\leqq 0.15 \quad (3).$$

4. The image forming method according to claim 1, wherein the absorbance peak specific to the crystalline polyester resin is at a wavelength of 1165 $cm^{-1}$, and a baseline thereof is drawn from 1199 to 1137 $cm^{-1}$; the absorbance peak specific to the amorphous resin is at a wavelength of 699 or 829 $cm^{-1}$, and baselines thereof are drawn from 670 to 714 $cm^{-1}$ or from 784 to 889 $cm^{-1}$, respectively; and the absorbance peak specific to the wax is at a wavelength of 2850 $cm^{-1}$, and a baseline thereof is drawn from 2834 to 2862 $cm^{-1}$.

5. The image forming method according to claim 1, wherein the crystalline polyester resin is a crystalline aliphatic polyester resin having an ester bond represented by the following formula (I) in an amount of 60% by mole or more in a main chain thereof;

$$\text{—OCO—R—COO—}(CH_2)_n\text{—} \quad (I)$$

wherein R represents a residue group of a straight-chain unsaturated aliphatic divalent carboxylic acid; and n represents an integer of from 2 to 6.

6. A toner, comprising:

a mother toner comprising a crystalline polyester resin, an amorphous resin, and a wax; and an external additive, wherein the toner satisfies the following equation (1):

$$0.36\leqq(2.77\times C/R+1.97\times W/R)/X\leqq 1.85 \quad (1)$$

wherein each of C, W, and R represents a height of an absorbance peak specific to the crystalline polyester resin, the wax, and the amorphous resin, respectively, measured by a FT-IR ATR method; and X represents an amount (parts by weight) of the external additive.

7. The toner according to claim 6, wherein the toner further satisfies the following equation (2):

$$0.36\leqq(2.77\times C/R+1.97\times W/R)/X\leqq 0.75 \quad (2).$$

8. The toner according to claim 6, wherein the toner further satisfies the following equation (3):

$$0.03\leqq C/R\leqq 0.15 \quad (3).$$

9. The toner according to claim 6, wherein the crystalline polyester resin is a crystalline aliphatic polyester resin having an ester bond represented by the following formula (I) in an amount of 60% by mole or more in a main chain thereof;

$$—OCO—R—COO—(CH_2)_n— \quad (I)$$

wherein R represents a residue group of a straight-chain unsaturated aliphatic divalent carboxylic acid; and n represents an integer of from 2 to 6.

* * * * *